United States Patent [19]

von Knorring et al.

[11] 4,401,146

[45] Aug. 30, 1983

[54] ROLLER BLINDS

[76] Inventors: Enar S. von Knorring, 38 Barkevagen, 770 20 Soderbarke; Folke H. T. Swensson, 76, Vastmannagatan, 113 26 Stockholm, all of Sweden

[21] Appl. No.: 235,364

[22] Filed: Feb. 19, 1981

[51] Int. Cl.[3] ..... E06B 9/20

[52] U.S. Cl. ..... 160/319; 160/242

[58] Field of Search ..... 160/242, 319, 320, 321, 160/322, 323 B, 323 R; 112/235; 248/266–270; 24/136 A, 116 A

[56] References Cited

U.S. PATENT DOCUMENTS

| | | | |
|---|---|---|---|
| 816,820 | 4/1906 | Pouliot | 160/319 |
| 2,299,060 | 10/1942 | Sarran et al. | 160/319 |
| 2,445,452 | 7/1948 | Peed | 160/321 |
| 2,494,759 | 1/1950 | Hirschy | 24/136 A |
| 2,855,215 | 10/1958 | Sheren | 24/116 A |
| 3,934,832 | 1/1976 | Zilver | 160/319 |
| 4,139,044 | 2/1979 | Brolin | 160/321 |

FOREIGN PATENT DOCUMENTS

| | | | |
|---|---|---|---|
| 65054 | 7/1942 | Norway | 160/242 |

*Primary Examiner*—Peter M. Caun

*Assistant Examiner*—Cherney S. Lieberman

*Attorney, Agent, or Firm*—William A. Drucker

[57] ABSTRACT

A roller blind structure of the kind comprising an elongated tubular member, having secured thereto one end of a fabric web and being rotatably mounted in elongated openings in two spaced apart brackets so as to allow said tubular member to be also displaced towards and away from a window or the like and further having a flanged reel secured to said elongated member and a cord which has one end thereof secured to said reel and wound up in a direction opposite to the winding direction of the web. A cover with elongated upper and lower walls is provided to form an elongated recess for receiving the flanged reel in a manner to allow it to be displaced with the tubular member. The cover further has in the lower wall thereof an elongated opening permitting the passage of the cord in a substantially vertical direction independent of the actual displacement position of the reel. The elongated opening may have a widened portion where the cord passes when the tubular member is in its innermost position and may either be integral with one of the brackets or made as a separate part, which can be detachably connected to said bracket.

6 Claims, 5 Drawing Figures

ROLLER BLINDS

BACKGROUND OF THE INVENTION

1. Field of the Invention

The present invention relates to a roller blind structure comprising an elongated preferably tubular member having at the ends thereof axially extending studs which are rotatably and displaceably received in slots provided in two spaced apart brackets provided to be secured to the upper part of a window casing or the like such that said elongated member when rotated in a clockwise direction moves in one direction along said slots but when rotated in an anticlockwise direction moves in the opposite direction along said slots. The elongated member is rotated by means of a cord attached to the hub of a flanged reel secured to one end of said elongated member and a fabric is secured to said elongated member and wound up thereon in a direction opposite to that of said cord such that when fabric is unrolled from the elongated member, the cord is wound upon the reel and vice versa. If the fabric is wound upon the elongated member in such a direction that it is unrolled from said member when the latter is rotated such that it moves towards the window the fabric will seal against said window casing when the fabric goes down.

2. Description of the Prior Art

The U.S. patent application Ser. No. 06/095,039, now U.S. Pat. No. 4,347,885, describes a roller blind structure of the kind referred to and to achieve that the cord will reel and unreel in a proper manner without forming loops and without leaving the reel there is according to said U.S. patent application provided a sleeve having an axially extending slot and said sleeve is mounted over said reel to be displaced therewith but without being rotated therewith. To this end such a sleeve has an axially projecting portion to engage a surface of said bracket to allow said sleeve to be displaced but not rotated and thus said sleeve has to have a precise orientation when mounted over the reel. It has proven that this is no problem when the roller blind is first installed as the installation is carried out with the aid of a written instruction. When—however—the elongated member with the fabric screen has been taken down for instance for cleaning the screen or changing the cord, the installation instruction in most instances is not available and as a consequence thereof the sleeve is often improperly mounted and as a result thereof the blind will not function and may also be damaged. It has also been found that the sleeve can be stuck in one position especially when the cord is rapidly operated and also in this case the proper function of the blind is in danger. The sleeve must be made with a certain clearance in all directions to be able to move properly but it cannot be avoided that the sleeve offers such a resistance that the force which has to be applied to the cord for winding up the screen will reach an unacceptable level.

SUMMARY OF THE INVENTION

With these and other drawbacks of the known device in mind one object of the invention is to provide a roller blind structure of the kind referred to which ensures a proper reeling and unreeling of the cord and which is easily installed with the risk for improper installation and malfunction minimized.

Another object of the invention is to provide an inexpensive and estethical structure.

The foregoing and other objects of the invention have been attained by providing a cover member with an upper wall, a lower wall and at least a front wall, at least the lower wall having an elongated opening extending longitudinally to allow the passage of a cord secured to the hub of a flanged reel, rotateably received within said cover, said flanged reel being further provided to be displaced in said cover member while rotating, said opening having such an extension that it allows said cord to leave said cover member in a substantially vertical direction independent of the position of said reel.

BRIEF DESCRIPTION OF THE DRAWINGS

The drawings illustrate a preferred embodiment of the invention and a modification of one of the parts thereof.

DETAILED DESCRIPTION OF THE PREFERRED EMBODIMENT

Figure 1:
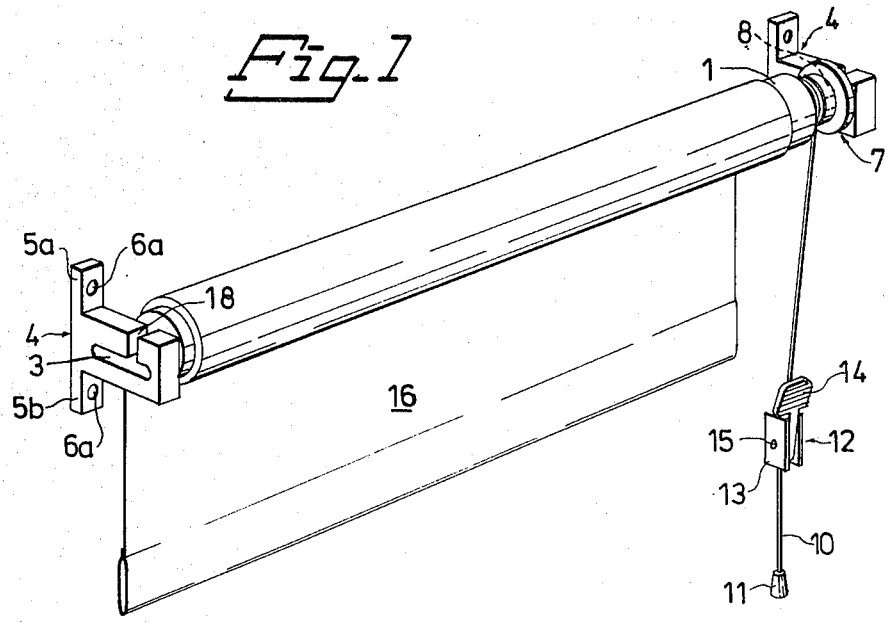
FIG. 1 is a perspective view of a roller blind according to the invention but without the cover.
Figure 2:
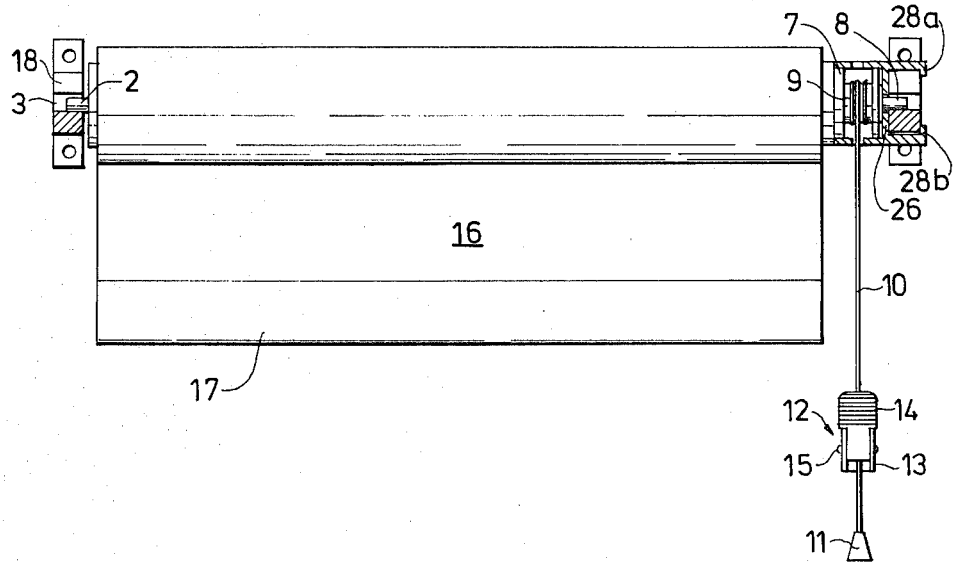
FIG. 2 is a front view partly in section of the improved roller blind.

Referring to FIGS. 1 and 2 of the drawing the improved roller blind comprises an elongated, tubular member 1 having at one end thereof an axially projecting stud 2 which is intended to be displaceably and rotateably received in an elongated opening 3 provided in a bracket 4. Said bracket is intended to be fastened to a window frame or the like by means of screws and has an upper projection 5*a* and a lower projcetion 5*b*, both of said projections having a hole 6*a* respectively 6*b* for such screws. Said tubular member 1 is at the opposite end thereof provided with a flanged reel 7 and an axially projecting stud 8, which latter like stud 2 is intended to be displaceably and rotateably received in an elongated opening 3 provided in another bracket 4.

Secured to the hub 9 of the reel is one end of a cord 10 which preferably is provided at the free end thereof with a knob 11. Said cord passes through a locking device 12 which comprises a U-shaped member 13 and a spring operated lever 14 which by means of a pin 15 is pivotally connected to the flanges of the U-shaped member 13 in such a manner that it locks the cord by pressing it against the web portion of said U-shaped member but releases the cord when said lever against the spring action is pivoted.

Secured to the elongated tubular member is one end of a web or screen 16 which in the opposite end thereof is folded over and forms a pocket 17 in which is received a wooden bar or the like to hold said screen stretched and to facilitate the unwinding of said screen from the tubular member 1.

To enable the elongated member 1 to be connected to the brackets in an easy manner the latter have vertical openings 18 communicating with the elongated openings 3 such that the studs 2 and 8 of said elongated tubular member may be dropped into said openings 3 via the openings 18.

The roller blind now described substantially corresponds to the roller blind structure of the U.S. patent application Ser. No. 06/095,039, now U.S. Pat. No. 4,347,885.

Figure 3:
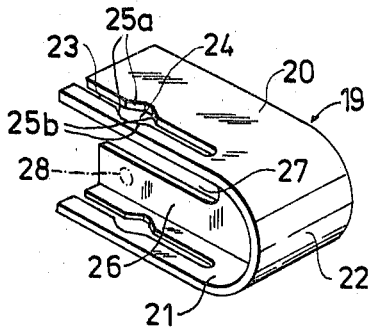
FIG. 3 is a perspective view of a cover member of the roller blind.

In order to guide cord 10*a* cover member 19 as illustrated in FIG. 3 is utilized. Said cover member comprises an upper wall 20, a lower wall 21 and a preferably curved front wall 22. Extending from the rear end of said upper wall 20 is a slot 23 having a widened portion 24 with bevelled or curved transition surfaces 25*a* and 25*b* respectively. An identical slot is provided in the lower wall 21 as clearly appears from FIG. 3.

As seen in FIG. 2 and FIG. 3 cover 19 has a wall 26 with an elongated opening 27 such that said stud 8 may pass into the elongated opening 3 of one of the brackets 4.

Figure 4:
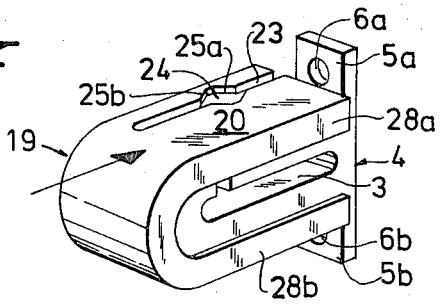
FIG. 4 is a perspective view of a combined cover and bracket and FIG. 5 is a perspective view of a somewhat modified cover member.

Cover 19 further has walls 28*a* and 28*b* respectively provided to engage one side surface of bracket 4 when wall 26 engages the opposite side surface of said bracket. Cover 19 further has minor projections 28 provided to be received in corresponding grooves in the bracket 4 to which cover member 19 is to be connected when the cover is in place. The cover member is made from a plastic material with resilient properties and it is thus clear that said projections 28 may snap into said grooves to releasably lock the cover to the bracket in question. It is further obvious that the cover is easily connected to the bracket by pushing it onto the bracket in question in the direction of the arrow of FIG. 4 and disconnected from the bracket when pulled in a direction opposite to the arrow.

The function of the roller blind is as follows. To install the roller blind the web or fabric 16 is wound upon the elongated member 1 in one direction and the cord 10 is wound upon the hub of the flanged reel 7 in the opposite direction and the studs 2 and 8 are then introduced in the openings 3 of the brackets via the vertical openings 18. The cover member 19 is then slid onto the bracket in the direction of the arrow in FIG. 4 until the projections 28 snap into the recesses of the bracket.

In operation the studs 2 and 8 roll against the surfaces which constitute the lower limits of the openings and, as a consequence thereof, the elongated member moves towards the window when said elongated member is rotated in one direction and moves away from the window when said elongated member is rotated in the opposite direction. In most instances the fabric and cord are wound up so as to achieve that the fabric web will moe towards the window when the curtain goes down and to achieve that the cord will reel and unreel in a proper manner without forming loops and, without leaving the reel, the slot 23 extends in the direction in which the cord moves, i.e. towards or away from the window. This movement takes place whenever the blind is operated, but by arranging the openings 3 inclined, it is possible to give the elongated member a tendency always to return to its innermost position. It has been found that by designing the slot 23 with a transversely widened portion 24 located in the zone where the cord leaves the cover when the elongated member is in its innermost position, i.e. nearest to the window, the cord will be guided so as to be properly wound up in layer after layer and, to give the cord a tendency to rapidly move into said zone, the curved or bevelled surfaces 25*a*,25*b* are provided. Thus a proper reeling and unreeling is achieved and by providing slots 23 of the kind referred to in the lower wall as well as in the upper wall of cover member 19 the latter may—by being placed upside down—be alternatively used with right and left hand located reel 7.

Figure 5:
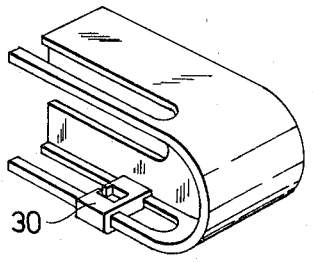

Instead of the widened portion 24 the cover may have a slide 30 displaceably arranged as shown in FIG. 5. By such an arrangement the cord is free to be wound upon the hub of the reel in the entire width thereof independent of in which position relative to the window the elongated member may be. As shown the slide is slit up to allow the cord to be pressed into said slide. Although the cover has now been described as a separate part it may also be integral with one of the brackets 4.

It is obvious that the walls 20 and 21 are parallel and that the distance between them slightly exceeds the diameter of the reel flanges such that the cord is prevented from leaving the reel and also jamming between the flanges and said walls.

What we claim is:

1. Improvements in such roller blinds and the like which comprise a rotatably mounted roller, a flanged reel or pulley coaxially and fixedly secured to one end of said roller, a cord having one end thereof secured to said reel and being provided to be rolled upon the hub of said reel or unrolled therefrom to lower or raise the blind, and a cover housing said reel and having an opening for the passage of the cord, said cover having an elongated upper wall, an elongated lower wall and at least a front wall, the inner surface of said upper wall being parallel to the inner surface of said lower wall and spaced therefrom a distance slightly exceeding the diameter of the flanges of said flanged reel, at least said lower wall having an elongated opening to allow the passage of said cord, said reel being further provided to be displaced along said elongated walls when rotated, thereby also causing the roller to be displaced transversely, said elongated opening having such an extension that it allows said cord to pass through the same in a substantially vertical direction independent of the actual position of said reel relative to said cover.

2. Improvements as claimed in claim 1 wherein the elongated opening is in the shape of an open slot extending from the rear end of the cover.

3. Improvements as claimed in claim 1 wherein said opening is widened at least in a zone in which the cord leaves the reel when the latter is in its innermost position.

4. Improvements as claimed in claim 1 wherein said cover is provided to be detachably secured to a bracket by pushing said cover longitudinally over said bracket, said cover and said bracket being provided with interengagable means to releasably hold said cover and said bracket in the secured position.

5. Improvements as claimed in claim 1 wherein said cover has also a side wall having an elongated opening for an axially extending stud of said reel.

6. Improvements as claimed in claim 1 wherein a cord guide means, having a transversely extending opening, bridges said elongated opening of said cover and is displaceable along said opening.

* * * * *